US006319880B1

(12) United States Patent
Okaniwa et al.

(10) Patent No.: US 6,319,880 B1
(45) Date of Patent: Nov. 20, 2001

(54) GREASE COMPOSITION FOR CONSTANT VELOCITY JOINT

(75) Inventors: Takashi Okaniwa; Junichi Imai, both of Fujisawa; Yukio Hasegawa; Shinichi Takabe, both of Iwata, all of (JP)

(73) Assignees: Kyodo Yushi Co., Ltd., Tokyo; NTN Corporation, Osaka, both of (JP)

( * ) Notice: Subject to any disclaimer, the term of this patent is extended or adjusted under 35 U.S.C. 154(b) by 0 days.

(21) Appl. No.: 09/606,180

(22) Filed: Jun. 29, 2000

(30) Foreign Application Priority Data

Jun. 29, 1999 (JP) ..... 11-184148

(51) Int. Cl.[7] ..... C10M 115/08; C10M 125/22

(52) U.S. Cl. ..... 508/168; 508/364; 508/365; 508/433; 508/438; 508/551; 508/552

(58) Field of Search ..... 508/551, 168

(56) References Cited

U.S. PATENT DOCUMENTS

| | | | | |
|---|---|---|---|---|
| 3,095,375 | | 6/1963 | Pitman | 508/147 |
| 3,223,624 | | 12/1965 | Morway et al. | 508/164 |
| 3,730,895 | | 5/1973 | Kjonaas | 508/176 |
| 3,840,463 | | 10/1974 | Froeschmann et al. | 508/161 |
| 4,062,785 | * | 12/1977 | Nibert | 508/551 |
| 4,536,308 | | 8/1985 | Pehler et al. | 508/335 |
| 4,743,389 | * | 5/1988 | Braid et al. | 508/551 |
| 4,759,859 | | 7/1988 | Waynick | 508/159 |
| 4,787,992 | | 11/1988 | Waynick | 508/163 |
| 4,830,767 | | 5/1989 | Waynick | 508/163 |
| 4,840,740 | | 6/1989 | Sato et al. | 508/364 |
| 4,902,435 | | 2/1990 | Waynick | 508/163 |
| 5,126,062 | | 6/1992 | Barnes | 508/163 |
| 5,160,645 | | 11/1992 | Okaniwa et al. | 508/356 |
| 5,207,936 | | 5/1993 | Anzai et al. | 508/168 |
| 5,589,444 | | 12/1996 | Hatakeyama | 508/168 |
| 5,607,906 | | 3/1997 | Okaniwa et al. | 508/168 |
| 5,952,273 | | 9/1999 | Suzuki et al. | 508/168 |
| 6,037,314 | | 3/2000 | Kondo et al. | 508/363 |

FOREIGN PATENT DOCUMENTS

| | | |
|---|---|---|
| 0 508 115 | 10/1992 | (EP) . |
| 0 558 099 | 9/1993 | (EP) . |
| 0 811 675 | 12/1997 | (EP) . |
| 2 761 372 | 10/1998 | (FR) . |
| 62-207397 | 9/1987 | (JP) . |
| 4-41714 | 7/1992 | (JP) . |
| WO 94/11470 | 5/1994 | (WO) . |
| WO 96/02615 | 2/1996 | (WO) . |

* cited by examiner

*Primary Examiner*—Ellen M. McAvoy
(74) *Attorney, Agent, or Firm*—Oblon, Spivak, McClelland, Maier & Neustadt, P.C.

(57) ABSTRACT

A grease composition for constant velocity joints comprises the following components: (a) a base oil; (b) a diurea type thickening agent; (c) a molybdenum sulfurized dialkyl dithiocarbamate; (d) molybdenum disulfide; (e) at least one sulfur-phosphorus-containing extreme-pressure agent selected from the group consisting of zinc dithiophosphate compounds and thiophosphates; and (f) a fatty acid amide. The grease composition of the present invention has a high ability of reducing the induced thrust force and is excellent in the durability.

10 Claims, 1 Drawing Sheet

GREASE COMPOSITION FOR CONSTANT VELOCITY JOINT

BACKGROUND OF THE INVENTION

The present invention relates to a grease composition for constant velocity joints of motorcars, in particular, a sliding type constant velocity joints. More specifically, the present invention pertains to a grease composition for constant velocity joints, which can efficiently lubricate the portions of a constant velocity joint which are easily worn out and are liable to generate abnormal vibrations or the like; can effectively reduce the wear; can suppress any vibration; and can improve the useful life of the joint.

Recently, FF cars have rapidly increased, from the viewpoint of, for instance, reduction of the weight and the insurance of the accommodation space of a car, functional 4WD cars have likewise increased and accordingly, there have widely been used constant velocity joints (CVJ) suitable for these applications. An embodiment of a double offset joint (DOJ) is shown in FIG. 1, which is used as a sliding type joint among these CVJ's. In this DOJ, when the joint transmits a running torque, while it has a working angle, the joint undergoes complicated rolling and sliding motions at the fitting position of track grooves 3 of an outside wheel 1, track grooves 4 of an inside wheel 2 and balls 5, and the frictional resistance in the sliding portions of the joint generates a force in the axial direction. This force is referred to as "an induced thrust force". This DOJ is provided with track grooves 3 on the internal face of the outside wheel 1 at intervals of 60 degrees and therefore, the induced thrust force is generated 6 times per revolution.

If the cycle of such induced thrust forces is in agreement with the natural frequencies of, for instance, an engine, a car body and/or a suspension, a resonance of the car body is induced and this gives a disagreeable impression to the passengers of the car. Therefore, it is desirable to reduce the foregoing induced thrust force to a level as low as possible. In a packaged motorcar, inconvenience such as beating and stuffy sounds are generated during the high speed travelling of the motorcar due to the resonance. In addition, the lubricating conditions for the DOJs have increasingly become severer as the weight of the car has been reduced and the generating power of the engine has been increased, and correspondingly, the joint should be improved in the durability.

The conventional lithium-containing extreme-pressure grease, which comprises a sulfur-phosphorus-containing extreme-pressure additive, and a lithium-containing extreme-pressure grease composition, which comprises molybdenum disulfide, suffer from a problem concerning the vibration resistance. Moreover, these conventional extreme-pressure greases are greatly worn out under high contact pressure conditions and accordingly, they are also insufficient in the durability. Moreover, Japanese Un-Examined Patent Publication No. Sho 62-207397 discloses an extreme-pressure grease composition, which comprises, as an essential component, a sulfur-phosphorus-containing extreme-pressure additive comprising a combination of a molybdenum sulfurized dialkyl dithiocarbamate and at least one member selected from the group consisting of sulfurized fats and oils, sulfurized olefins, tricresyl phosphate, trialkyl phosphates and zinc dialkyl dithiophosphates. However, the extreme-pressure grease composition disclosed in this patent is still insufficient in the durability.

SUMMARY OF THE INVENTION

Accordingly, it is an object of the present invention to provide a grease composition for constant velocity joints, which is highly effective for reducing any induced thrust force and excellent in the durability.

It is another object of the present invention to provide a grease composition for constant velocity joints, which can efficiently lubricate such a constant velocity joint when it is applied to sites thereof to be lubricated, can efficiently inhibit any wear of the joint and is excellent in heat resistance and durability.

The inventors of this invention have conducted various intensive studies to achieve the foregoing objects, have found that the drawbacks associated with the conventional grease compositions for constant velocity joints can effectively be eliminated by the use of a specific combination of compounds and thus have completed the present invention.

More specifically, the foregoing object of the present invention can be accomplished by providing a grease composition for constant velocity joints, which comprises the following components:

(a) a base oil;

(b) a diurea type thickening agent;

(c) a molybdenum sulfurized dialkyl dithiocarbamate;

(d) molybdenum disulfide;

(e) at least one sulfur-phosphorus-containing extreme-pressure agent selected from the group consisting of zinc dithiophosphate compounds and thiophosphates; and (f) a fatty acid amide.

The constant velocity joints, to which the grease composition according to the present invention is applied, are particularly preferably sliding type constant velocity joints.

DESCRIPTION OF THE PREFERRED EMBODIMENTS

Figure 1:
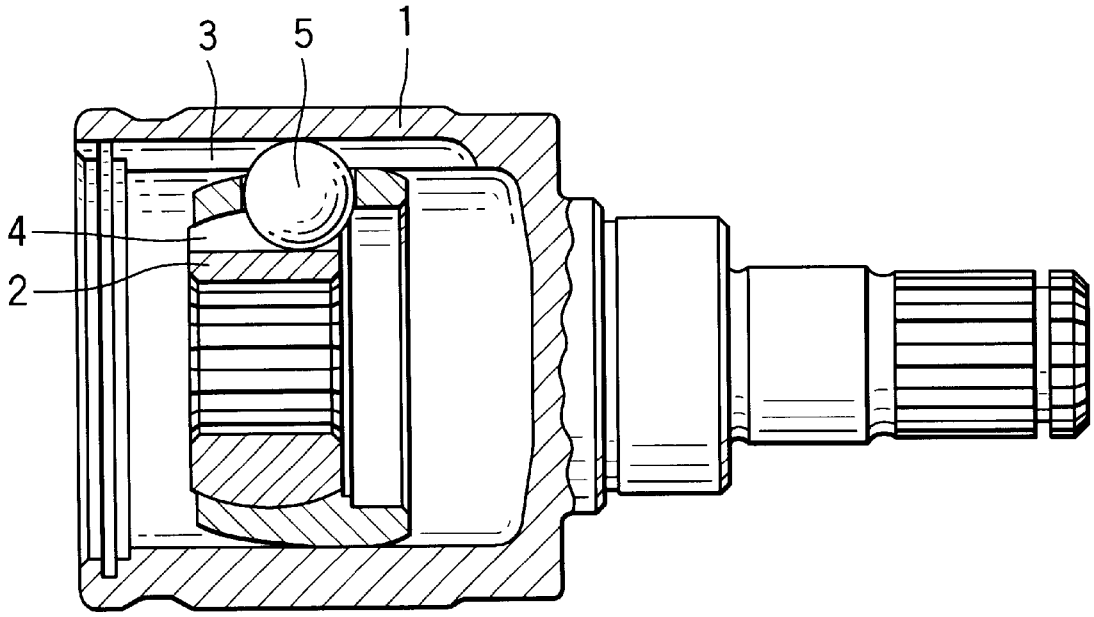
FIG. 1 is a partially broken side view showing an embodiment of a double offset type joint to which the grease composition according to the present invention can suitably be applied.

As the base oil used in the present invention as the component (a), there may be used, for instance, mineral oils, ester type synthetic oils, ether type synthetic oils and hydrocarbon type synthetic oils. These base oils may be used alone or in any combination of at least two of them.

The diurea compound, i.e., diurea type thickening agent used in the present invention as the component (b) may be, for instance, those prepared through reactions of diisocyanates with monoamines. In this respect, specific examples of such diisocyanates are phenylene diisocyanate, diphenyl diisocyanate, phenyl diisocyanate, diphenylmethane diisocyanate, octadecane diisocyanate, decane diisocyanate and hexane diisocyanate, while specific examples of such monoamines include octylamine, dodecylamine, hexadecylamine, octadecylamine, oleylamine, aniline, p-toluidine and cyclohexylamine.

Particularly preferred diurea type thickening agents are diurea compounds prepared by reacting aliphatic amines such as octylamine and stearylamine, cyclohexylamine, aniline or mixture thereof with diisocyanate compounds.

Particularly preferably, the component (c) used in the present invention, i.e., molybdenum sulfurized dialkyl dithiocarbamates are those represented by the following formula (1):

$$[R^1R^2N—CS—S]_2—Mo_2OmSn \quad (1)$$

Wherein $R^1$ and $R^2$ each independently represents an alkyl group having 1 to 24 carbon atoms and m+n=4, provided that m ranges from 0 to 3 and n ranges from 4 to 1.

These compounds are known solid lubricating agents and disclosed in, for instance, Japanese Examined Patent Publication Nos. Sho 45-24562 (compounds represented by Formula (1), wherein m ranges from 2.35 to 3 and n ranges from 1.65 to 1) and Sho 53-31646 (compounds represented by Formula (1) wherein m ranges from 0.5 to 2.3 and n ranges from 3.5 to 1.7).

The molybdenum disulfide used in the present invention as the component (d) is generally widely used as a solid lubricating agent. This compound has a layer lattice structure, is easily sheared into a thin layer structure due to sliding motions and accordingly, the compound shows effects of inhibiting any metal-metal contact and of inhibiting any seizure.

If it is added in a large amount, however, it would adversely affect the vibration resistance. In addition, it may sometimes increase the extent of wear depending on the lubricating conditions.

Examples of the component (e) or thiophosphates preferably used in the present invention are those represented by the following formula (2):

$$(R^3O)(R^4O)P(=S)(OR^5) \quad (2)$$

Wherein $R^3$ represents an alkyl group, a cycloalkyl group, an alkyl cycloalkyl group, an aryl group, an alkylaryl group or an arylalkyl group, having 1 to 24 carbon atoms, and $R^4$ and $R^5$ each represents a hydrogen atom or an alkyl group, a cycloalkyl group, an alkyl cycloalkyl group, an aryl group, an alkylaryl group or an arylalkyl group having 1 to 24 carbon atoms.

Particularly preferred thiophosphates are those represented by Formula (2) wherein $R^3$, $R^4$ and $R^5$ are alkyl groups having 12 or 13 carbon atoms, i.e., trialkyl thiophosphates; and tri (alkylphenyl) thiophosphates.

Preferred examples of zinc dithiophosphate compounds used in the present invention as the component (e) include those represented by the following formula (3):

$$[(R^6O)_2\text{—}PS\text{—}S]_2\text{—}Zn \quad (3)$$

In Formula (3), $R^6$ represents an alkyl group having 1 to 24 carbon atoms or an aryl group having 6 to 30 carbon atoms. Particularly preferred are those represented by Formula (3) in which $R^6$ represents a primary or secondary alkyl having 3 to 8 carbon atoms.

Preferred examples of fatty acid amides used in the present invention as the component (f) are palmitamide and stearamide represented by the following formula (4):

$$R^7CONH_2 \quad (4)$$

In Formula (4), $R^7$ represents an alkyl group having 16 to 17 carbon atoms.

In the present invention, the grease composition preferably comprises 1 to 25% by weight of a diurea type thickening agent (b); 0.1 to 5% by weight of a molybdenum sulfurized dialkyl dithiocarbamate (c); 0.1 to 5% by weight of molybdenum disulfide (d); 0.1 to 5% by weight of a sulfur-phosphorus-containing extreme-pressure agent (e); and 0.1 to 5% by weight of a fatty acid amide (f), on the basis of the total weight of the grease composition.

If the content of the component (b) is less than 1% by weight, that of the component (c) is less than 0.1% by weight, that of the component (d) is less than 0.1% by weight, that of the component (e) is less than 0.1% by weight and that of the component (f) is less than 0.1% by weight, the intended effect of the resulting grease composition is sometimes insufficient. On the other hand, if the content of the component (b) is more than 25% by weight, that of the component (c) is more than 5% by weight, that of the component (d) is more than 5% by weight, that of the component (e) is more than 5% by weight and that of the component (f) is more than 5% by weight, the resulting grease composition never shows any further improvement in the effects.

The present invention will hereunder be described in more detail with reference to the following Examples and Comparative Examples, but the scope of the present invention is not restricted by these specific Examples at all.

EXAMPLES 1 TO 4 AND COMPARATIVE EXAMPLES 1 TO 5

To a container, there were added 4100 g of a base oil and 1012 g of diphenylmethane-4,4'-diisocyanate and the resulting mixture was heated to a temperature ranging from 70 to 80° C. To another container, there were added 4100 g of a base oil, 563 g of cyclohexylamine and 225 g of aniline, followed by heating the resulting mixture to a temperature ranging from 70 to 80° C. and addition of the mixture to the foregoing container. The temperature of the mixture was raised up to 160° C. while it was sufficiently stirred and then it was allowed to stand to give a base urea grease A. To the base grease A, there were added the additives specified in the following Table 1 in the amounts likewise specified in Table 1, a base oil was if necessary added thereto and the resulting mixture was treated with a three stage roll mill to thus adjust the consistency of the mixture to the No. 1 grade.

In all of the foregoing Examples and Comparative Examples, the base oil used for the grease compositions was a mineral oil having the following characteristic properties:

Viscosities: 154 $mm^2/s$ and 13.2 $mm^2/s$ as determined at 40° C. and 100° C., respectively;

Viscosity Index: 73

Moreover, a commercially available molybdenum disulfide grease was used as Comparative Example 5. The results thus obtained are summarized in the following Table 1 together with the consistencies (60 W) (as determined according to JIS K 2220) and the dropping points (° C.) thereof (as determined according to JIS K 2220).

1. Induced Thrust Force Measuring Test: A true joint (a double offset type joint) was rotated while imparting a working angle to the joint and applying a torque thereto to thus determine a force generated in the axial direction, which was defined to be the induced thrust force. The induced thrust force is expressed in terms of the rate of reduction (%) relative to the induced thrust force observed for the commercially available molybdenum disulfide grease (Comparative Example 5).

Test Conditions:

Number of Revolution: 900 rpm

Torque: 15 kgf·m

Angle: 5 deg.

Measuring Time: 5 minutes after the initiation of the revolution.

2. Durability: A true joint (a double offset type joint) was rotated and the durability was evaluated under the following conditions:

Test Conditions:

Number of Revolution: 1500 rpm

Torque: 30 kgf·m

Angle: 5 deg.

Criteria:

⊙: excellent; ○: good; Δ: slightly insufficient; X: insufficient.

TABLE 1

| Example No. | 1 | 2 | 3 | 4 |
|---|---|---|---|---|
| Base Grease | | | | |
| Grease A | 93.0 | 94.0 | 92.5 | 96.0 |
| Additives | | | | |
| 1) Component (c) | 3.0 | 3.0 | 3.0 | 2.0 |
| 2) Component (d) | 1.0 | 1.0 | 1.0 | 0.5 |
| 3) Component (e) | 1.0 | 0.5 | — | 0.5 |
| 4) Component (e) | — | 0.5 | 0.5 | — |
| 5) Component (f) | 2.0 | 1.0 | 3.0 | 2.0 |
| Total | 100 | 100 | 100 | 100 |
| Consistency (60 W) | 326 | 325 | 324 | 325 |
| Dropping Point (° C.) | 260< | 260< | 260< | 260< |
| Induced Thrust Force | −71 | −68 | −64 | −64 |
| Durability | ◎ | ◎ | ◎ | ◎ |

| Comparative Example | 1 | 2 | 3 | 4 | 5 |
|---|---|---|---|---|---|
| Base Grease | | | | | |
| Grease A | 96.0 | 94.0 | 94.0 | 95.0 | — |
| Additives | | | | | |
| 1) Component (c) | — | 3.0 | 3.0 | 3.0 | — |
| 2) Component (d) | 1.0 | — | 1.0 | 1.0 | — |
| 3) Component (e) | 1.0 | 1.0 | — | 1.0 | — |
| 4) Component (e) | — | — | — | — | — |
| 5) Component (f) | 2.0 | 2.0 | 2.0 | — | — |
| Total | 100 | 100 | 100 | 100 | — |
| Consistency (60W) | 325 | 324 | 326 | 324 | 285 |
| Dropping Point (° C.) | 260< | 260< | 260< | 260< | 196 |
| Induced Thrust Force | −27 | −65 | −34 | −59 | ±0 |
| Durability | X | Δ | X | Δ | X |

1) Molybdenum sulfurized dialkyl dithiocarbamate (trade name: Molyvan A, available from R. T. Vanderbilt Company);
2) Molybdenum disulfide (Molysulfide, available from CLIMAX MOLYBDENUM Company, average particle size: 0.45 μm);
3) Thiophosphate (Irgalube 211 available from CIBA-GEIGY Company);
4) Zinc dithiophosphate compound (Lubrizol 1360 available from Nippon LUBRIZOL Company); and
5) Fatty acid amide (Armide HT Powder available from Lion Akzo Company).

The grease compositions prepared in Examples 1 to 4, which comprise Components (c) to (f) showed high rates of reducing the induced thrust force and are also excellent in the durability. Contrary to this, there were observed low rates of reducing induced thrust force and insufficient durabilities for the grease compositions of Comparative Example 1 free of any Component (c), Comparative Example 2 free of any Component (d), Comparative Example 3 free of any Component (e) and Comparative Example 4 free of any Component (f).

As has been described above in detail, the grease composition of the present invention has a high ability of reducing the induced thrust force and is excellent in the durability.

What is claimed is:

1. A grease composition for constant velocity joints, comprising the following components:

(a) a base oil;

(b) a diurea type thickening agent;

(c) a molybdenum sulfurized dialkyl dithiocarbamate;

(d) molybdenum disulfide;

(e) at least one sulfur-phosphorus-containing extreme-pressure agent selected from the group consisting of zinc dithiophosphate compounds and thiophosphates; and (f) a fatty acid amide selected from the group consisting of palmitamide and stearamide.

2. The grease composition for constant velocity joints as set forth in claim 1 wherein the constant velocity joint is a sliding type constant velocity joint.

3. The grease composition for constant velocity joints as set forth in claim 1 wherein it comprises 1 to 25% by weight of a diurea type thickening agent; 0.1 to 5% by weight of a molybdenum sulfurized dialkyl dithiocarbamate; 0.1 to 5% by weight of molybdenum disulfide; 0.1 to 5% by weight of sulfur-phosphorus-containing extreme-pressure agent; and 0.1 to 5% by weight of said fatty acid amide, on the basis of the total weight of the grease composition.

4. The grease composition for constant velocity joints as set forth in claim 3 wherein the constant velocity joint is a sliding type constant velocity joint.

5. The grease composition for constant velocity joint as set forth in claim 3, wherein the component (b) is a product obtained by a reaction of a diisocyanate with a monoamine and wherein the diisocyanate is a member selected from the group consisting of phenylene diisocyanate, diphenyl diisocyanate, phenyl diisocyanate, diphenylmethane diisocyanate, octadecane diisocyanate, decane diisocyanate and hexane diisocyanate and the monoamine is a member selected from the group consisting of octylamine, dodecylamine, hexadecylamine, octadecylamine, oleylamine, aniline, p-toluidine and cyclohexylamine.

6. The grease composition for constant velocity joint as set forth in claim 3, wherein the component (c) is a member selected from the group consisting of those represented by the following formula (1):

$$[R^1R^2N—CS—S]_2—Mo_2OmSn \quad (1)$$

(in the formula (1), $R^1$ and $R^2$ each independently represents an alkyl group having 1 to 24 carbon atoms and m+n=4, provided that m ranges from 0 to 3 and n ranges from 4 to 1).

7. The grease composition for constant velocity joint as set forth in claim 3, wherein the component (e) is a member selected from the group consisting of those represented by the following formula (2):

$$(R^3O)(R^4O)P(=S)(OR^5) \quad (2)$$

(in the formula (2), $R^3$ represents an alkyl group, a cycloalkyl group, an alkyl cycloalkyl group, an aryl group, an alkylaryl group or an arylalkyl group having 1 to 24 carbon atoms, and $R^4$ and $R^5$ each represents a hydrogen atom or an alkyl group, a cycloalkyl group, an alkyl cycloalkyl group, an aryl group, an alkylaryl group or an arylalkyl group having 1 to 24 carbon atoms).

8. The grease composition for constant velocity joints as set forth in claim 7, wherein in the formula (2), $R^3$, $R^4$ and $R^5$ are alkyl groups each having 12 or 13 carbon atoms.

9. The grease composition for constant velocity joints as set forth in claim 3, wherein the component (e) is a member selected from the group consisting of those represented by the following formula (3):

$$[(R^6O)_2—PS—S]_2—Zn \quad (3)$$

(in the formula (3), $R^6$ represents an alkyl group having 1 to 24 carbon atoms or an aryl group having 6 to 30 carbon atoms.

10. The grease composition for constant velocity joints as set forth in claim 9, wherein in the formula (3), $R^6$ represents a primary or secondary alkyl having 3 to 8 carbon atoms.

* * * * *